United States Patent [19]

Johnson

[11] Patent Number: 4,700,032

[45] Date of Patent: Oct. 13, 1987

[54] KEYBOARD APPARATUS AND METHOD FOR MAKING SAME

[75] Inventor: Larry K. Johnson, North Attleboro, Mass.

[73] Assignee: Texas Instruments Incorporated, Dallas, Tex.

[21] Appl. No.: 335,140

[22] Filed: Dec. 28, 1981

Related U.S. Application Data

[62] Division of Ser. No. 99,440, Dec. 3, 1979, Pat. No. 4,332,082.

[51] Int. Cl.[4] ..... H01R 9/00

[52] U.S. Cl. ..... 200/159 B; 200/5 A; 29/622

[58] Field of Search ..... 200/159 B, 5 A; 29/622, 29/831

[56] References Cited

U.S. PATENT DOCUMENTS

| | | | |
|---|---|---|---|
| 1,794,831 | 3/1931 | Caruso | 29/831 |
| 3,237,282 | 3/1966 | Reith | 29/831 X |
| 3,697,711 | 10/1972 | Tetrick | 200/159 B |
| 3,742,157 | 6/1973 | Leposavic | 200/159 B |
| 3,950,846 | 4/1976 | Johnson | 29/622 X |
| 4,158,115 | 6/1979 | Parkinson et al. | 200/159 B X |
| 4,258,096 | 3/1981 | LaMarche | 200/159 B X |

FOREIGN PATENT DOCUMENTS

| | | | |
|---|---|---|---|
| 2929574 | 2/1981 | Fed. Rep. of Germany | 200/159 B |

*Primary Examiner*—Henry J. Recla
*Assistant Examiner*—Renee S. Luebke
*Attorney, Agent, or Firm*—John A. Haug; James P. McAndrews; Melvin Sharp

[57] ABSTRACT

A keyboard is assembled by providing first and second electrically conductive strips of layers and first and second electrically insulative strips of layers, forming the layers into a desired configuration and laminating them together with the respective insulative layers intemediate and on top of the conductive layers. Switching areas are delineated on at least one of the conductive layers and are joined to each other and are provided with output leads by conductive paths configured from the conductive layer. The interposed insulative layer is formed with a plurality of apertures located so that an aperture can be aligned with each switching area. After the layers are laminated together they are blanked out from the strips and holes are punched out through the four layers to sever selected conductive paths and form a preselected circuit pattern.

5 Claims, 7 Drawing Figures

KEYBOARD APPARATUS AND METHOD FOR MAKING SAME

Figure 1:
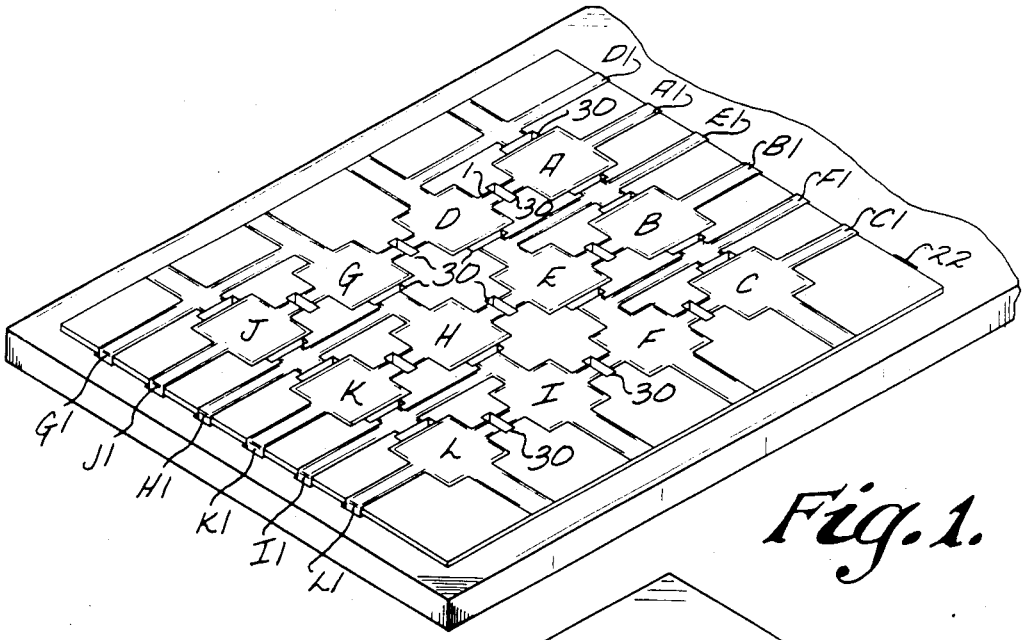

This is a division, of application Ser. No. 99,440, filed 12.03.79 now U.S. Pat. No. 4,332,082.

The present invention relates generally to keyboard systems and more particularly is directed to an improved push-button system in which the actuating button has very little motion or tactile feel and a method for making such a system.

In recent years many types of keyboard systems have been developed for use in transmitting coded electrical information in various types of equipment. Typically such keyboard systems utilize push-button members appropriately symbolized in a manner indicative of a numeric, alphabetic or mathematical function generated in response to the actuation of the push-button member to establish electrical connection between various conductive paths and various circuit elements coupled to the system in order to achieve a desired function.

During the early stage of keyboard development mechanical switches as used in typewriters became the accepted norm, and the general public became accustomed to associate actuation with key movement. In recent years, and particularly with the advent of small electrical equipment such as hand held calculators, keyboard systems having tactile feedback giving an indication of switch actuation and still with noticeable key motion have become widespread in use. By way of example U.S. Pat. No. 3,725,907 issued 4.3.73 shows such a system. Another type of keyboard system which is becoming more widely used provides little or no key motion with no tactile feel. Most solid state keyboards such as capacitive or inductive keyboards used with microwave oven controls and the like fall into this category. As more people become accustomed to using keyboards with little or no motion and no tactile feel the demand for inexpensive, yet reliable and easily manufactured keyboards increases with more and more applications being found for such systems. With respect to such systems it is known to provide keyboards having an electrically insulative substrate with electrically conductive portions disposed therein as in a conventional printed circuit board, with a sheet of flexible insulative material having conductive paths coated onto the bottom surface thereof disposed over the circuit board but spaced slightly therefrom by an apertured electrically insulative spacer sheet so that depression of the flexible sheet in the area of the apertures completes an electrical circuit between selected conductive portions on the circuit board and conductive paths on the overlying flexible sheet. Although less expensive than solid state keyboards such systems are still somewhat difficult and expensive to manufacture since they generally use relatively expensive conductive materials, e.g. a silver ink screened on the top layer and gold on the circuit board.

It is therefore an object of the present invention to provide an improved keyboard system having micro key motion and no tactile feel which is extremely conducive to mass manufacturing techniques and to provide a method for making such a keyboard system. It is another object to provide a keyboard system in which the particular circuit patterns for various applications can easily be changed with minimal effects in the manufacturing line used to produce the keyboards. Yet another object is the provision of a keyboard system and method for making which employs readily available and inexpensive materials. Other objects and features will in part be apparent and in part pointed out hereinafter.

Briefly, a keyboard is assembled in accordance with the present invention by providing separate reels of strips of first and second electrically conductive alloys, such as brass, and first and second electrically insulative material, such as polyester, paying out the strips to a station where the conductive strips and one of the insulative strips are configured into a desired shape, as by stamping with a die, leading the strips to a laminating station to bond them together and then directing the strips to a blanking station where individual keyboard units are separated from the several strips and a plurality of holes are punched through the layers to provide a selected circuit pattern. Switching areas are delineated on at least one conductive strip interconnected by conductive paths and provided with output leads both being formed during the configuring step. During the configuring step the first insulative strip is formed with a plurality of apertures so spaced that an aperture can be aligned with each respective switching area. In order to facilitate lamination of the strips together the first insulative strip is preferably provided with adhesive on both faces of the strip. In addition, if desired, an adhesive layer can be provided on the bottom face of the second conductive strip to facilitate mounting to a circuit board. After separation of the keyboard unit from the strips the output leads extending from the unit are bent downwardly and are received in mating holes on a circuit board and are soldered to the reverse side of the circuit board in electrical connection with a circuit network provided thereon.

The invention accordingly comprises the constructions and method steps hereinafter described, the scope of the invention being indicated in the following claims.

Figure 2:
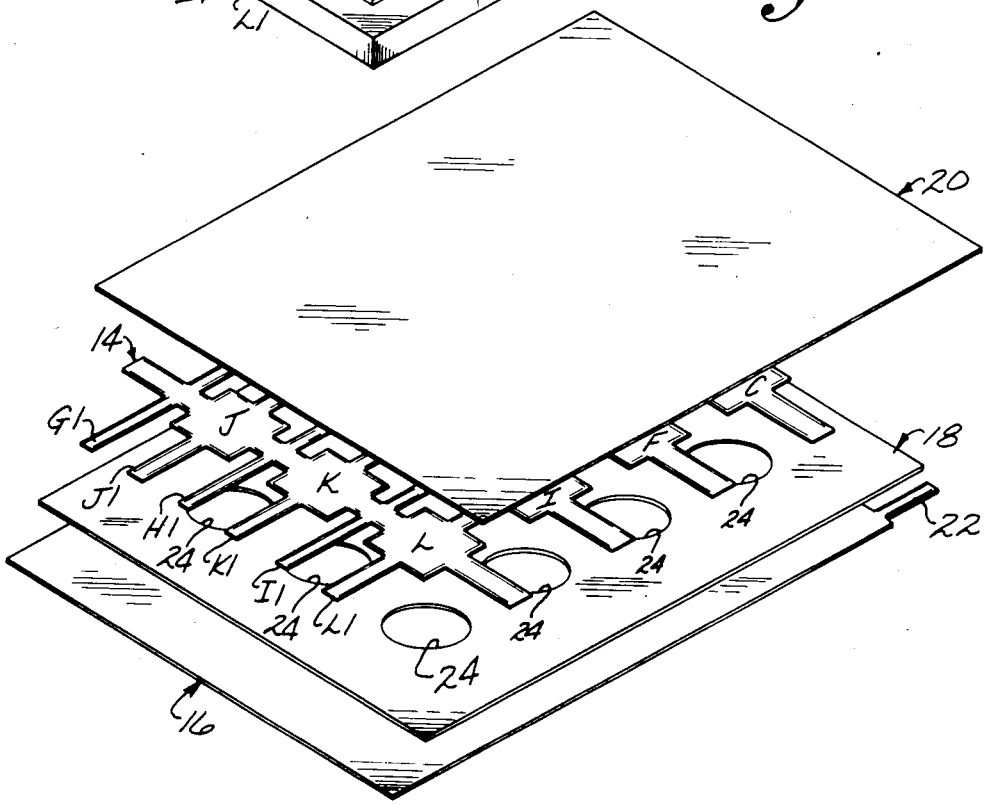
Figure 3:
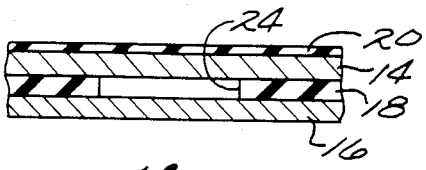
Figure 4:
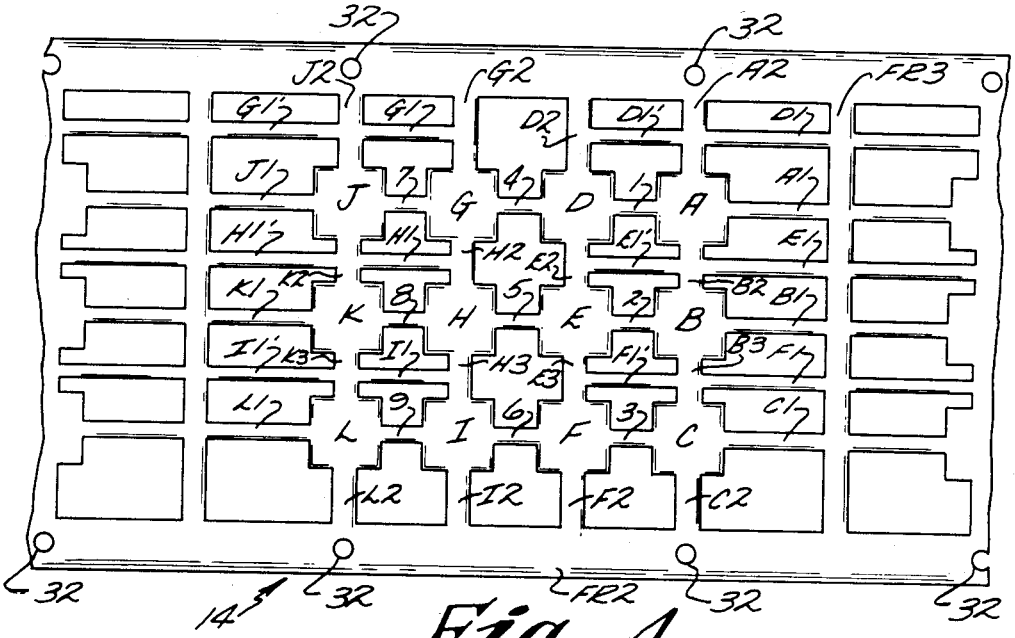
Figure 5:
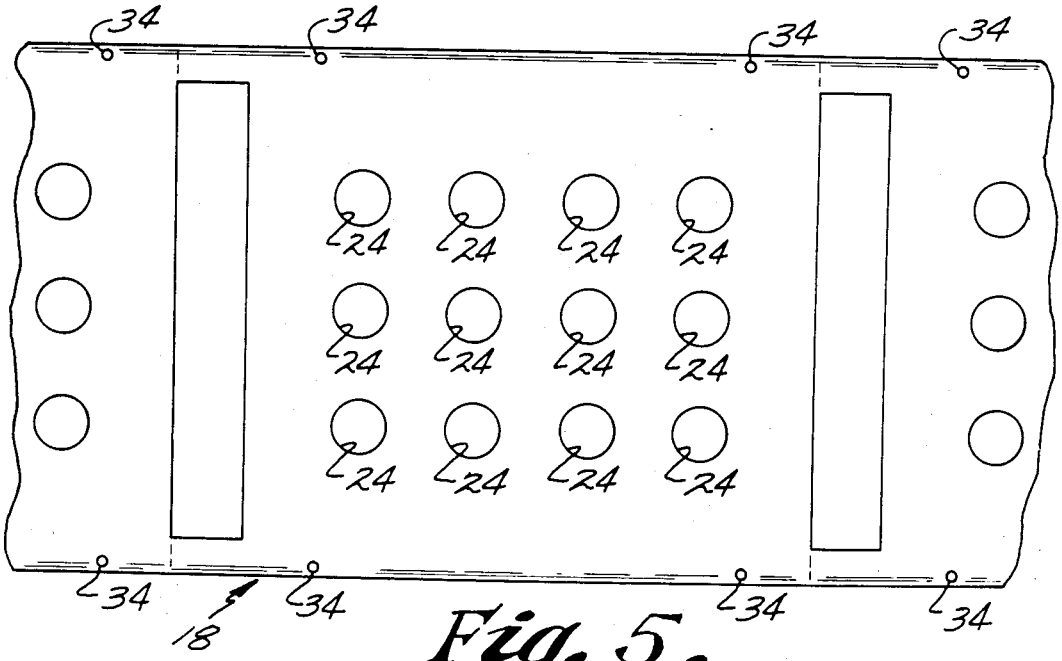
Figure 6:
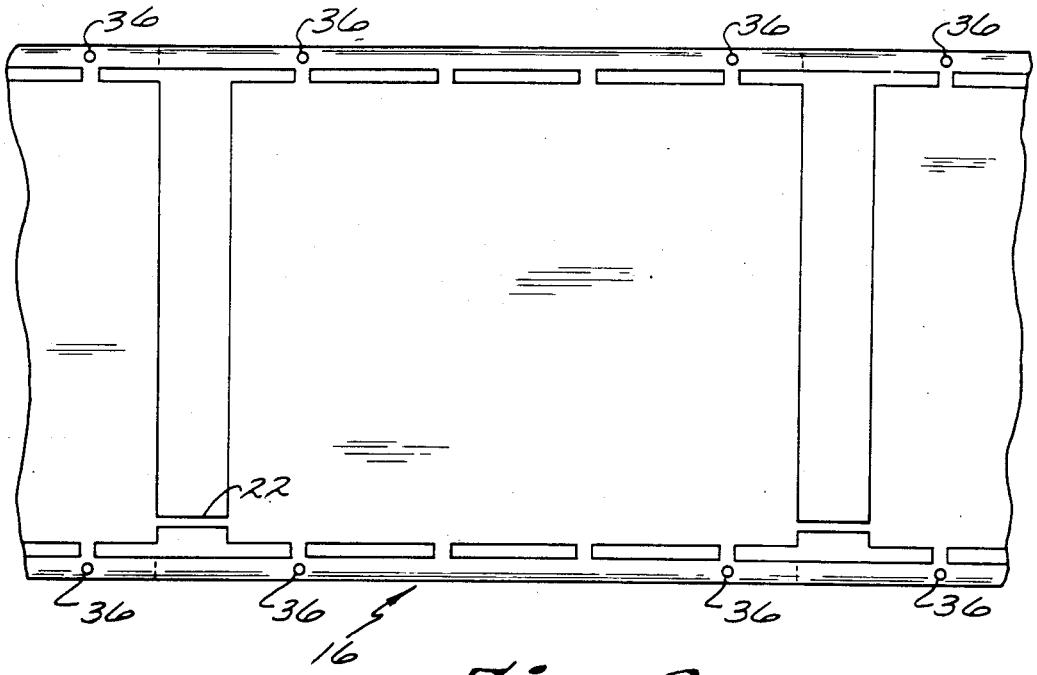
Figure 7:
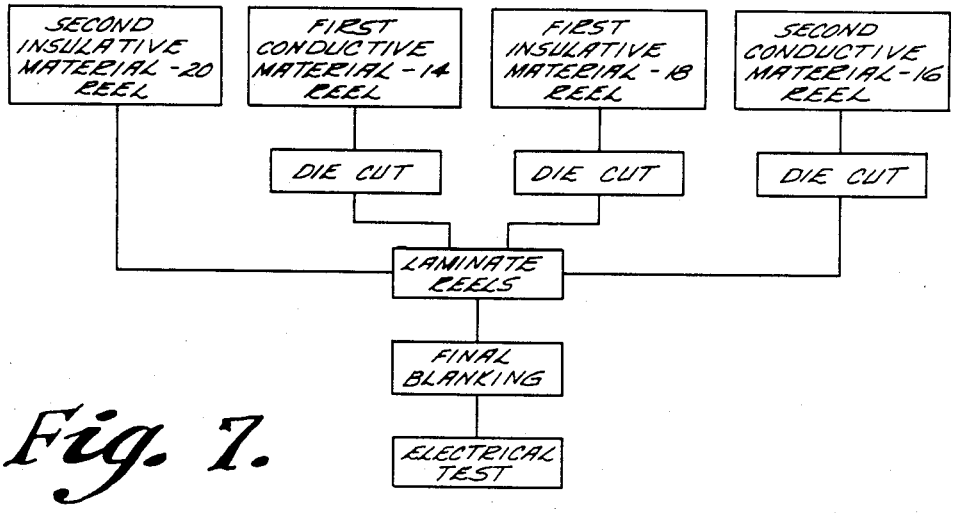

In the accompanying drawings, in which the preferred embodiment of the invention is illustrated, FIG. 1 is a perspective view of a portion of a circuit board on which a keyboard unit made in accordance with the invention is mounted, FIG. 2 is a perspective view of the several layers of material used in constructing the keyboard blown apart to facilitate illustration of the keyboard, FIG. 3 is a cross sectional view through a portion of the keyboard unit showing one of the switches, FIG. 4 is a top plan view of a portion of the first conductive strip after it has gone through the configuring step, FIG. 5 is a top plan view of a portion of the insulative layer following its configuring step, FIG. 6 is a top plan view of a portion of the second conductive layer following its configuring step, and FIG. 7 is a flow diagram depicting the main steps to which the four strips are subjected.

Corresponding reference characters indicate corresponding parts throughout the several views of the drawings.

Turning now to the drawings a keyboard unit 10 made in accordance with the invention is shown in FIG. 1 mounted on a suitable printed circuit board 12. As best seen in FIG. 2 unit 10 comprises a first electrically conductive layer 14, a second electrically conductive layer 16, a first electrically insulative layer 18 disposed between the two conductive layers and a second electrically insulative layer 20 disposed on top of conductive layer 14.

With particular reference to FIG. 4 conductive layer 14 is formed with a plurality of switching areas A–L which are interconnected by conductive paths 1–9 and A2, B2, B3, C2, D2, E2, E3, F2, G2, H2, H3, I2, J2, K2, K3 and L2 and are provided with output leads A1–L1.

Conductive layer 16 is configured as a solid sheet coextensive with all of the switching areas and is provided with lead 22 extending therefrom.

Insulative spacer layer 18 is coextensive with conductive layer 16 and is formed with a plurality of apertures 24 approximately the same size as the switching areas A–L and located so that each aperture can be aligned with a respective switching area. Insulative layer 20 disposed on top of conductive layer 14 is coextensive with layers 16 and 18 and serves as a sealing cover.

Insulative layer 18 is preferably provided with a heat or pressure sensitive adhesive layer on its two opposite faces and the four layers are pressed together to laminate them with the apertures in layer 18 aligned with respective switching areas. An adhesive layer is also preferably provided on the bottom of conductive layer 16 to facilitate mounting to circuit board 12.

Following lamination of the layers into a single unit a selected circuit pattern is provided by punching holes through the four layers severing selected conductive paths. As seen in FIG. 1 the conductive paths separating the switching areas from each other are all severed. By way of example a hole 30 is formed in the conductive path 1 between switching areas A and D. In the following description reference may be had to FIG. 4 for the numeral identifying the specific conductive path which has not been placed in FIG. 1 in order to avoid overcrowding the figure. Holes 30 are punched through layers 14, 16, 18 and 20 severing conductive paths 2–9 and between the following switching areas and conductive paths:

| | | |
|---|---|---|
| switching area | A | conductive paths D1, E1 |
| switching area | B | conductive paths E1, F1 |
| switching area | C | conductive paths F1 |
| switching area | D | conductive paths E1 |
| switching area | E | conductive paths F1 |
| switching area | G | conductive paths H1 |
| switching area | H | conductive paths I1 |
| switching area | J | conductive paths G1, H1 |
| switching area | K | conductive paths H1, I1 |
| switching area | L | conductive paths I1 |

After the selected conductive paths have been severed the output leads, leads A1–L1, and lead 22 are bent downwardly and the unit is then received on circuit board 12 which has been formed with a suitable array of bores. The leads are received in the bores and are soldered to circuit paths formed on the reverse side of board 12.

One of the important features of the invention is the fact that it is very conducive to mass manufacturing techniques. With reference to FIG. 7 respective reels of second insulative material 20, first conductive material 14, first insulative material 18 and second conductive material 16 are provided with the strips of material payed out with strips of materials 14, 18 and 16 directed along a path to a die cutter to impart the desired configuration described above to each of the strips. This can be done using conventional techniques either continuously or intermittently. Index holes 32, 34, and 36 are provided in respective strips 14, 18 and 16 to insure proper registry of the strips relative to one another. It will be appreciated that it is within the purview of the invention to configure the conductive strips by means other than stamping, such as by etching. Following the configuration step or operation the strips are pressed together to laminate them, then blanked out to separate the layers for each keyboard unit from the strips and sever the preselected conductive paths. The units may then be tested to insure that they function as intended and are ready for installation on a suitable circuit board. In a typical application circuit board 12 with the keyboard unit mounted thereon would be received in a suitable mounting frame and a thin, flexible layer having selected indicia thereon to depict the individual keys would be placed over layer 20.

Any suitable electrically conductive material may be used for both the first and second conductive layers. By way of example a brass comprising essentially 84.5% Copper and 11.5% Zinc has been found to be suitable. The first insulative layer used as the spacer can conveniently be a conventional polyester coated with a suitable adhesive on opposite faces thereof. All of the layers are formed from very thin stock so that the keyboard unit in turn is exceptionally thin. One such unit had the first and second conductive layers, and the insulative spacer layer each 0.003 inch thick and the top insulative sealer layer 0.001 inch. The specific dimensions and materials can be varied to obtain desired operating forces and stress characteristics. Using the materials just described, actuation of a switch by depressing cover layer 20, as seen in FIG. 3, will close a circuit path between a portion of conductive layer 14 and common conductive layer 16 with 0.003 inch travel. Following the severing of selected conductive paths as described above, depression of conductive layer 14 at any of the switching areas will result in a unique, selected output signal. The switches described are normally open, single pole, single throw, momentary contact switches.

The switch array described above is a typical pattern providing six outputs brought out from opposite ends of the keyboard unit. It is within the purview of the invention to provide other circuit configurations and more or fewer switching stations. The top and bottom conductive layers can be reversed so that the top layer is a single common layer. Alternatively, both conductive layers can have several outputs as long as the punch outs are properly located so as not to destroy desired electrical connections in the two conductive layers.

It is within the purview of the invention to screen insulative layer 16 onto one or both conductive layers rather than using a separate strip if desired.

In some instances it may be possible to provide the selected circuit pattern on the conductive layers without having to interrupt any conductive path by punching out holes, as in the case of a single row of switch areas.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

I claim:

1. Keyboard apparatus comprising first and second electrically conductive layers comprising discrete sheets of metal, an electrically insulative layer intermediate the two conductive layers, a plurality of apertures formed in the insulative layer, one of the conductive layers being configured into a plurality of switching areas lying in the plane of the layer with conductor paths directly interconnecting each switching areas with at least three other adjacent switching areas, each switching area aligned with a respective aperture formed in the insulative layer, the conductive layers and the insulative layer being bonded together whereby selected holes can be formed in and extend through the conductive layers and the insulative layer, each hole breaking a conductive path in order to provide a preselected circuit pattern for the apparatus.

2. Keyboard apparatus according to claim 1 further including a second layer of electrically insulative material disposed on and bonded to the conductive layer having the switching areas.

3. Keyboard apparatus according to claim 2 in which the first and second layers are each composed of approximately 0.003 of an inch metal, the first insulative layer is composed of approximately 0.003 of an inch polyester and the second insulative layer is composed of approximately 0.001 of an inch polyester.

4. Keyboard apparatus according to claim 1 in which the first and second conductive layers and the insulative layers are approximately the same thickness.

5. Keyboard apparatus according to claim 4 in which the first and second conductive layers are composed of a copper, zinc alloy.

* * * * *